United States Patent [19]

Amaral

[11] Patent Number: 4,895,547

[45] Date of Patent: Jan. 23, 1990

[54] SUPERIOR PERFORMANCE YO-YO

[76] Inventor: Leonard R. Amaral, 26 Harcourt St., Swansea, Mass. 02777

[21] Appl. No.: 303,648

[22] Filed: Jan. 27, 1989

[51] Int. Cl.[4] ..... A63H 1/30

[52] U.S. Cl. ..... 446/250

[58] Field of Search ..... 446/250, 251, 255

[56] References Cited

U.S. PATENT DOCUMENTS

| | | | |
|---|---|---|---|
| 3,175,326 | 3/1965 | Isaacson | 446/250 |
| 3,256,635 | 6/1966 | Radovan | 446/251 |
| 4,207,701 | 6/1980 | Kuhn | 446/250 |
| 4,332,102 | 6/1982 | Caffrey | 446/250 |

*Primary Examiner*—Mickey Yu

*Attorney, Agent, or Firm*—Wolf, Greenfield & Sacks

[57] ABSTRACT

A high performance yo-yo displays extended spinning time and is easy to use even by a beginner. The yo-yo includes two yo-yo halves connected by the axle. A spool formed from low friction polymeric material is mounted for free rotation on the axle and the yo-yo string is attached to the spool. When the yo-yo spins, the axle rotates freely within the spool. The axial play of the spool on the axle and the space between the yo-yo halves adjacent the spool are subject to certain critical values which provide the yo-yo with its desirable operating characteristics.

6 Claims, 2 Drawing Sheets

SUPERIOR PERFORMANCE YO-YO

FIELD OF THE INVENTION

This invention relates to improvements in yo-yo's.

BACKGROUND OF THE INVENTION

This invention relates to high performance yo-yos, that is, yo-yos adapted to spin or "sleep" for extended times so as to permit lengthy and extended tricks to be performed before the yo-yo is returned to the user.

It is among the desirable features of a yo-yo that it spin freely at the end of its string for as long a time as possible, this being referred to commonly as "sleeping". The yo-yo typically is provided with a string having a loop at its end which receives the axle of the yo-yo. When the yo-yo spins at the end of the string, the axle rotates rapidly and in direct contact with the string loop. The friction generated between the axle and the string severely impairs the duration that the yo-yo can spin and also results in premature string breakage. In order to extend the duration that the yo-yo spins, a number of yo-yos have incorporated low friction bearings. U.S. Pat. No. 3,175,326 (Isaacson) discloses a yo-yo having a roller bearing about its axial. U.S. Pat. No. 4,332,102 (Caffrey) discloses another high performance yo-yo that incorporates a bearing pulley about the axle of the yo-yo. The device described in the Caffrey patent, although free spinning, was thought to destroy the control of the operator to retrieve the yo-yo when desired and required the use of a clutch mechanism to effect a frictional grip between the pulley and the yo-yo to enable the yo-yos to be retrieved. Although the yo-yo described in the Caffrey patent displays superior performance in that it exhibits extended duration spins, it would be desirable to reduce the complexity and cost of that yo-yo.

Also among the desirable objects of a yo-yo is that it be easy to use. Typically, the higher performance yo-yos require somewhat more skill to use. For example, in order to make the yo-yo device described in the Caffrey patent sleep, the user must impart a relatively strong flick of the wrist when extending the yo-yo, a maneuver that is not always easily learned, particularly by some beginners. As a result, such beginners may be come discouraged easily.

It is among primary objects of the invention to provide a superior performance yo-yo that is of low cost, that displays an extremely long spinning time and which is easy to use, even by beginners.

SUMMARY OF THE INVENTION

The yo-yo of the present invention has two yo-yo halves connected by an axle. A cylindrical spool is mounted for free rotation on the axle and a string is attached securely to the spool. When the yo-yo spins, its axle rotates within the low friction spool which acts as a bearing. The present invention incorporates the discovery that by constructing the spool of the yo-yo to have axial movement limited to certain critical values and by controlling critically the space between the yo-yo halves, a high performance yo-yo is achieved which can be made to spin for unusually long times yet which may be returned easily with a simple flick of the wrist.

It is among objects of the invention to provide a high performance yo-yo that is easy to use by beginners as well as accomplished users.

A further object of the invention is to provide a high performance yo-yo that is of simple low cost construction.

DESCRIPTION OF THE DRAWINGS

The foregoing and other objects and advantages of the invention will be appreciated more fully from the following further description thereof with reference to the accompanying drawings wherein.

DESCRIPTION OF THE PREFERRED EMBODIMENT

Figure 2:
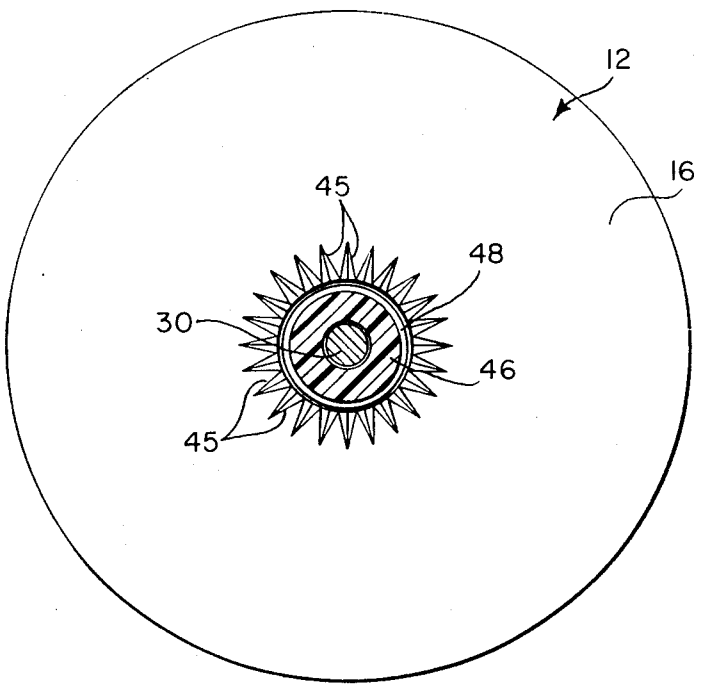
FIG. 2 is an illustration of the internal face of the yo-yo as seen along the plane 2—2 of FIG. 1.
Figure 1:
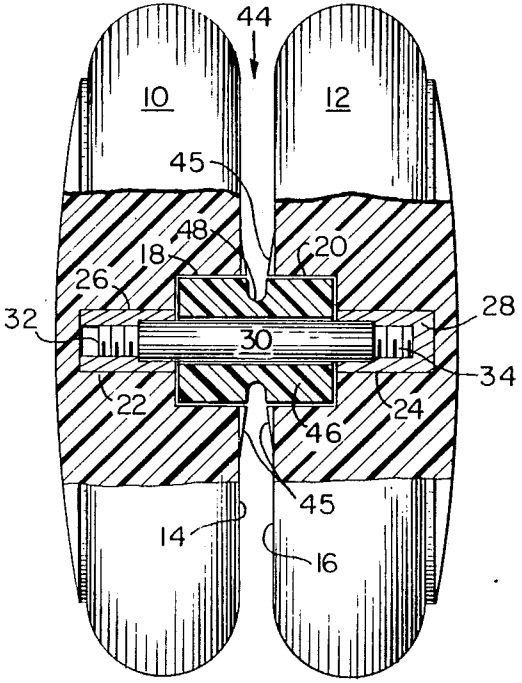
FIG. 1 is a sectional illustration taken through the diameter of the yo-yo.
Figure 3:
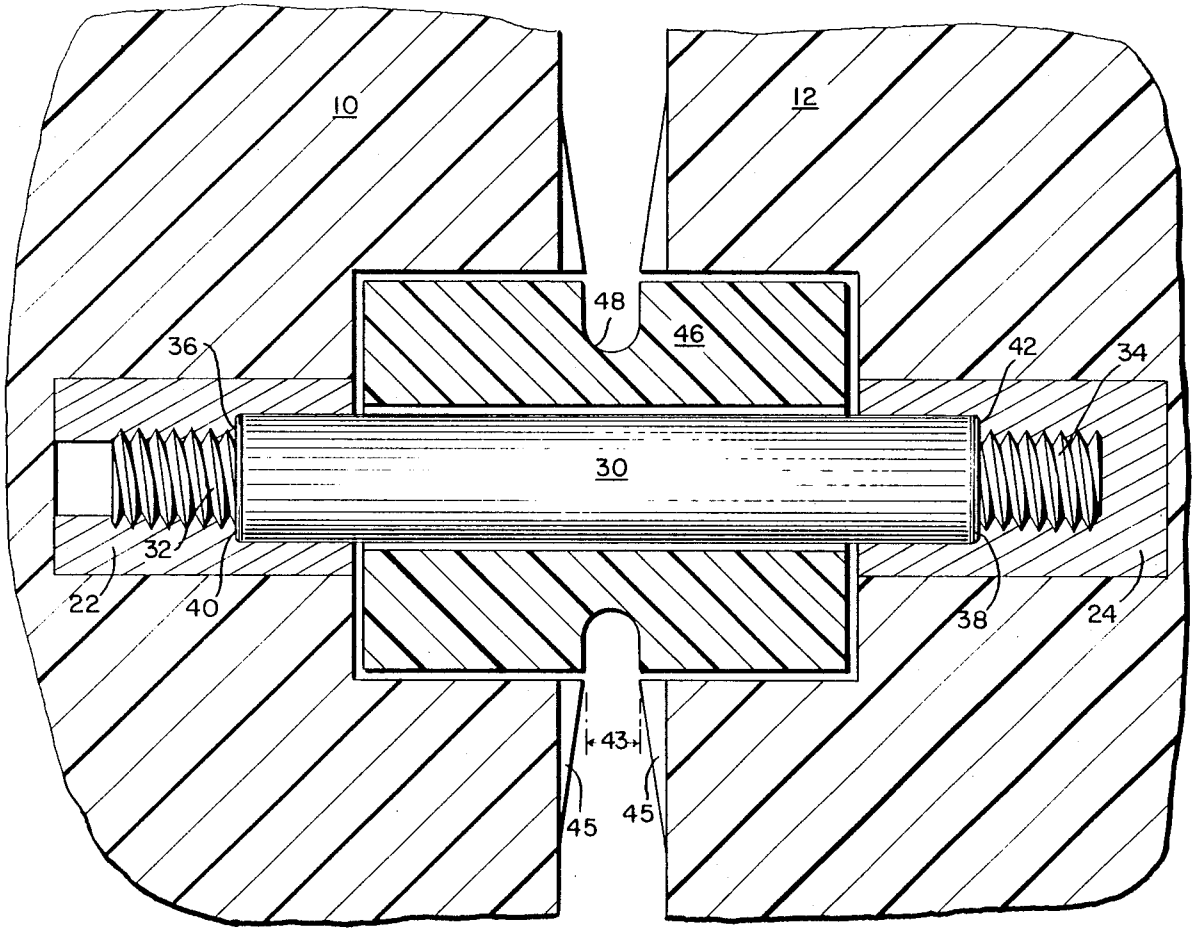
FIG. 3 is an enlarged diametral section through the region of the spool and axial of the yo-yo.

As shown in the drawings, the yo-yo includes a pair of yo-yo halves 10, 12 which preferably are formed from injection molded plastic, although they may be formed from other materials such as wood, metal or a combination thereof. The yo-yo halves may be about 2¼" diameter. The inwardly facing surfaces 14, 16 of the yo-yo halves 10, 12 are provided with cylindrical sockets 18, 20 which, in turn, are formed with internal bores 22, 24. The sockets 18, 20 and internal bores 22, 24 are aligned along the axis of rotation of the yo-yo. The yo-yo halves are essentially identical. Threaded inserts 26, 28, preferably of the type commercially available under the trade designation HeliCoil are embedded in the internal bores 22, 24, respectively. An axle 30, which may be formed from steel rod, having threaded ends 32, 34 is screwed into the threaded inserts 26, 28 as shown in FIGS. 1 and 3. The juncture of the unthreaded portion of the axle 30 with the threaded ends 32, 34 defines shoulders 36, 38 (see FIG. 3) which abut facing shoulders 40, 42 formed on the threaded inserts 26, 28.

The inwardly facing surfaces 14, 16 of the yo-yo halves may be provided with an arrangement of radially extending raised ribs 45 surrounding the sockets 18, 20 in somewhat of a starburst pattern. The ribs may be of the order of 0.125" long and may extend above the associated surfaces 14, 16 about 0.010". The ribs enhance the ability of the yo-yo to engage the string when retrieving the yo-yo. In accordance with one aspect of the invention, the space 44 between the yo-yo halves 10, 12 adjacent the spool is among the critical features of the invention and, therefore, it is important to assure that the threaded inserts 26, 28 are precisely located in the yo-yo halves 10, 12. Where the yo-yo halves 10, 12 are formed from injection molded plastic, it is possible to locate the inserts 26, 28 with such precision using conventional insert molding techniques.

The yo-yo includes a generally cylindrical spool 46 rotatably mounted on the axle 30, the ends of the spool 46 being received, symmetrically, within the sockets 18, 20 of the yo-yo halves 10, 12. By way of example, the axle may be of the order of 0.156" diameter the inner diameter of the spool 46 being about 0.005" to 0.008" in diameter larger than the axle. The spool 46 preferably is provided with a circumferential groove 48 about which the yo-yo string (not shown) may be fastened. The yo-yo is intended to be used with standard yo-yo strings commercially available from Lockport Assembly Company of Lockport, N.Y. Preferably the string is fastened in a double loop so that the spool 46 will not rotate with respect to the string. The spool 46 is formed from a polymeric material having good lubricity properties. For example, Delrin available from Du Pont has been found to be a suitable plastic. The polymeric material also should be machined to precise tolerances. Other plastics having good lubricity and machinability properties may be employed. The outer diameter of the spool 46 is slightly less than the diameter of the sockets 18, 20 so that when the yo-yo is suspended from its string, the yo-yo halves 10, 12 may spin freely without interference with the circumference of the spool. The axle 30 may be coated with a light film of lubricant further to enhance the low frictional characteristics of the device.

In order that the yo-yo may display superior long duration spinning, it is critical that the axial play of the spool 46 on the shaft (the difference between spool length and distance between ends of sockets 18, 20) be no greater than about 0.018" and preferably about 0.015". The clearance may be as low as about 0.001". I have discovered that as long as the axial play is maintained within those limits, the device will display superior spinning for long times. Also critical to the performance of the yo-yo is the facility with which the yo-yo may be returned to the user from a sleeping configuration with a simple flick of the wrist. By maintaining the space 43 between the facing ribs 45 of the yo-yo halves 10, 12 adjacent the spool between about 0.075" to 0.090", (space 44 being about 0.095" to 0.105") the yo-yo will return easily and controllably even though the string is attached to the freely rotatable spool 46. If the radial ribs 45 are omitted, the yo-yo halves may be placed closer together, bringing space 44 to about 0.075" to 0.090". Thus, the present invention achieves the desired characteristics of long spins and easily controlled return without requiring the use of complex clutches as in the aforementioned Caffrey patent.

From the foregoing it will be appreciated that the invention provides a superior performance yo-yo displaying long spinning times yet which is easily retrieved with a simple flick of the wrist. The device is adapted for use by beginners as well as more advanced players. The device avoids the need for a clutch mechanism and is of low cost, simple construction.

It should be understood, however, that the foregoing description of the invention is intended merely to be illustrative thereof and the other modifications and embodiments may be apparent to those skilled in the art without departing from its spirit.

Having thus described the invention what I desire to claim and secure by Letters Patent is:

1. A superior performance yo-yo comprising:

a pair of yo-yo halves;

an axle defined by a cylindrical shaft having connecting means securely connected to each of the halves at the axis of rotation of the yo-yo;

a spool rotatably mounted in contact with the axle between the yo-yo halves, the spool being freely rotatable on the axle and having a limited amount of axial play, the axial play being no greater than about 0.018";

the halves being spaced with respect to each other, adjacent the spool, between about 0.075" to about 0.090".

2. A yo-yo as defined in claim 1 further comprising:

each of the yo-yo halves having a cylindrical socket formed at its inner face to receive the ends of the spool.

3. A yo-yo as defined in claims 1 or 2 in which the spool has a circumferential groove formed about its periphery about the midsection of the spool.

4. A yo-yo as defined in claim 3 wherein the spool is formed from a low friction plastic material.

5. A yo-yo as defined in claim 1 further comprising:

the yo-yo halves having facing surfaces that are provided with an array each of a plurality of raised radially extending ribs about the axis of rotation of the yo-yo;

said spacing between the halves, adjacent the spool, being measured between the facing arrays of ribs.

6. A yo-yo as defined in claim 4 wherein:

the yo-yo halves having facing surfaces that are provided with an array each of a plurality of raised radially extending ribs about the axis of rotation of the yo-yo;

said spacing between the halves, adjacent the spool, being measured between the facing arrays of ribs.

* * * * *